US007491080B2

(12) United States Patent
Houir Alami et al.

(10) Patent No.: US 7,491,080 B2
(45) Date of Patent: Feb. 17, 2009

(54) SEALED ELECTRICAL CONNECTION ELEMENT

(75) Inventors: Mounim Houir Alami, Paris (FR); Arnaud Calbel, Vaires sur Marne (FR)

(73) Assignee: Societe d'Exploitation des Porcedes Marechal (SEPM), Saint Maurice (FR)

( * ) Notice: Subject to any disclaimer, the term of this patent is extended or adjusted under 35 U.S.C. 154(b) by 0 days.

(21) Appl. No.: 11/995,078

(22) PCT Filed: Mar. 16, 2007

(86) PCT No.: PCT/FR2007/000455

§ 371 (c)(1),
(2), (4) Date: Jan. 8, 2008

(87) PCT Pub. No.: WO2007/118948

PCT Pub. Date: Oct. 25, 2007

(65) Prior Publication Data

US 2008/0200055 A1 Aug. 21, 2008

(30) Foreign Application Priority Data

Mar. 17, 2006 (FR) ..... 06 02358

(51) Int. Cl.
*H01R 13/52* (2006.01)

(52) U.S. Cl. ..... 439/277; 439/294

(58) Field of Classification Search ..... 439/271–277, 439/289, 292–294, 587–589
See application file for complete search history.

(56) References Cited

U.S. PATENT DOCUMENTS 4,203,640 A * 5/1980 Bice et al. ..... 439/139

FOREIGN PATENT DOCUMENTS

| | | |
|---|---|---|
| DE | 90 13 436 U1 | 1/1991 |
| DE | 199 63 614 A1 | 8/2000 |
| FR | 2 551 272 A1 | 3/1985 |
| WO | WO-00/31836 A1 | 6/2000 |

* cited by examiner

*Primary Examiner*—Tho D Ta
(74) *Attorney, Agent, or Firm*—Greenblum & Bernstein, P.L.C.

(57) ABSTRACT

Electrical connection element provided with peripherally distributed electrical contacts designed to cooperate with the corresponding contact pins of a plug, a rotary safety disk being provided and having peripheral perforations the number and position of which are chosen, on the one hand, at rest, to conceal the peripheral contacts of the connection element and, on the other hand, be superimposed therewith when the disk driven by the pins of the plug is rotated, whereas sealing blocks are positioned under the safety disk so as to seal off the peripheral perforations thereof in the rest position. The sealing blocks are positioned on a sealing disk also provided with perforations, and which is formed under the safety disk and mounted fixed in terms of rotation and able to move in terms of translation against the action of an elastic arrangement which biases it towards the safety disk.

13 Claims, 3 Drawing Sheets

SEALED ELECTRICAL CONNECTION ELEMENT

BACKGROUND OF THE INVENTION

1. Field of the Invention

The invention is directed to a sealed electrical connection element which constitutes, for example, the base of a power outlet, or the movable outlet of an extension cord or a connector.

2. Description of Background and Other Information

A connection element known for the above-mentioned applications is generally provided with peripherally distributed electrical contacts mounted in an insulating block, which are designed to cooperate with the corresponding contact pins of a plug, after the coupling of said plug with said element during at least a first translation movement followed by a rotation and a second translation, while a rotary safety disk is provided above the insulating block of the connection element and consists of peripheral perforations the number and positioning of which are selected, on the one hand, to conceal the peripheral contacts of the connection element at rest and, on the other hand, to be superimposed on the latter after the rotation of the disk carried by the pins of the plug which were inserted into said perforations of the disk during the first translation movement.

In order to guarantee that said elements are sealed at rest, they generally include a pivoting and lockable cover on a housing on which the insulating block and the contacts are arranged, said cover being closed with a seal on the housing in the resting position.

Apart from the different problems to be resolved in order to ensure a good seal with such a cover (efficiency of the joints, fitting of the closure, etc.), there is the major inconvenience of the user being compelled to close the cover after use, unless there is an automatic closure by an elastic means but which then compels the user to open the cover and to keep it in this position against its elastic means during the manipulations involved in coupling the plug and the element.

As described in the document DE-9013436U1, it has also been envisioned to have a connection element of the above-mentioned general type additionally including sealing blocks which are positioned under the safety disk in an equal number and arranged in the same manner as the peripheral perforations of the latter so as to seal the perforations completely in the rest position under the effect of elastic means, said sealing blocks being able to be disengaged from the peripheral perforations by the pins of the plug.

However, in this device, the sealing blocks are positioned in the insulating block provided with contacts.

Because it is necessary to have as many sealing blocks as there are contacts, it limits to this extent in the insulator the possible number of locations and compartments for the contacts, which may prove to be unacceptable for connection elements requiring more than two contacts and/or for devices of reduced size and/or for which the distribution and positioning of the contacts are determined by technical constraints, in particular to permit the provision of a large number of different currents while preventing the risks of electrical incompatibility.

SUMMARY OF THE INVENTION

To notably overcome this inconvenience, the invention includes a connection element of the above-cited type equipped with sealing blocks, but which is especially remarkable in that the sealing blocks are arranged on a sealing disk which is positioned under the safety disk, which also includes at least an equal number of peripheral perforations which are arranged in the same manner as the peripheral perforations of the safety disk, while being angularly offset in relation to the sealing blocks, and which is mounted fixed in rotation and movable in translation against an elastic arrangement which urges it towards the safety disk, in order to ensure a resting position in which the sealing blocks close the peripheral perforations of the safety disk, while the sealing disk may be pushed away from the safety disk by the pins of the plug during the first translation movement in such a way that the sealing blocks are disengaged from the perforations of the safety disk which may therefore be pulled in rotation by the pins, which may then come into the connection position by crossing the peripheral perforations of the sealing disk, the latter reassuming its sealed closing position during the uncoupling of the plug and the element, under the effect of the elastic arrangement with which it is equipped.

In this way, the invention ensures an automatic seal with a simplified device in which the sealing blocks also do not take up any space in the insulator.

Advantageously, the safety disk is equipped with a central extension on which is mounted in a movable manner and in translation the sealing disk equipped for this purpose with a central perforation with a shape complementary to that of the extension.

According to one embodiment, the elastic arrangement which urges the sealing disk towards the safety disk are composed of springs positioned appropriately under each of the blocks.

In addition, for example, the safety disk and the insulating block are equipped with an arrangement for ensuring the seal of the safety disk at its periphery, such arrangement for ensuring the seal being composed for example of a peripheral groove which is arranged in a sheath surrounding the insulating block of the element and in which the safety disk turns, and an annular joint housed in the groove of the sheath.

According to one embodiment, each sealing block is composed of a lug with a shape corresponding to the perforation of the safety disk to be closed and an annular joint arranged at its base, which comes to be applied in the closure position under the safety disk.

BRIEF DESCRIPTION OF THE DRAWINGS

The invention will be well understood and other particularities will emerge on reading the description to follow which refers to the annexed drawings in which.

DETAILED DESCRIPTION OF THE INVENTION

The drawings represent a connection element 1 of the power outlet base type, or even a movable outlet of an extension cord or a connector.

Figure 3:
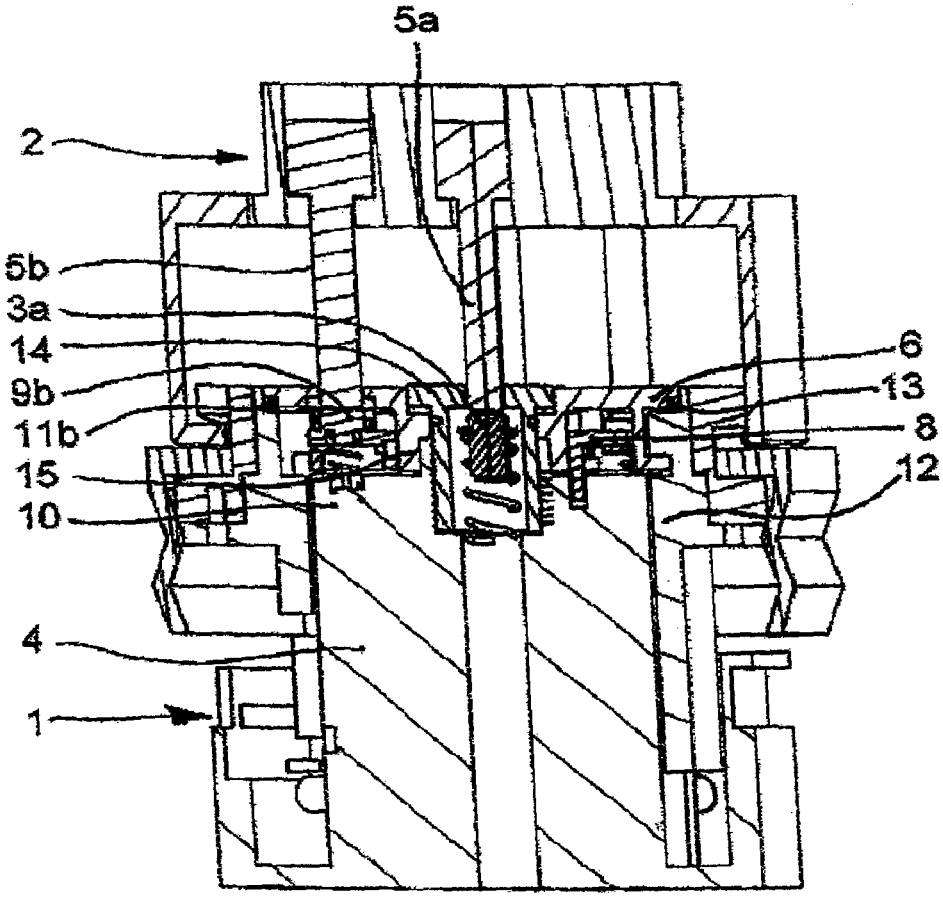
FIG. 3 corresponds to the cross-section of FIG. 2 representing, in addition, a connection plug intended to be coupled to the connection element and after the insertion of the plug by a first translation movement.
Figure 5:
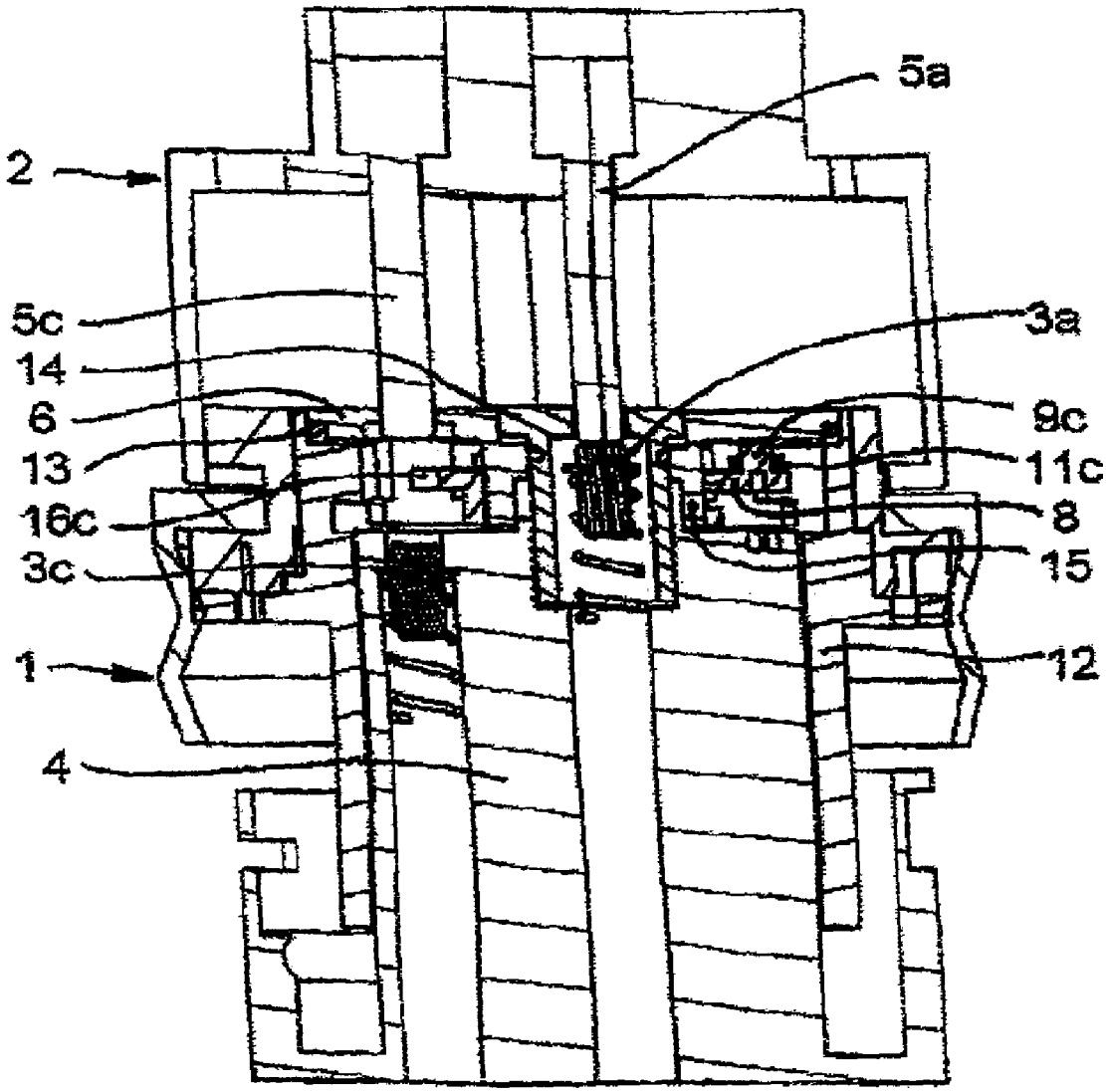
FIG. 5 is a section along the line V-V of FIG. 4 with, in addition, the representation of a plug as in FIG. 3.
Figure 1:
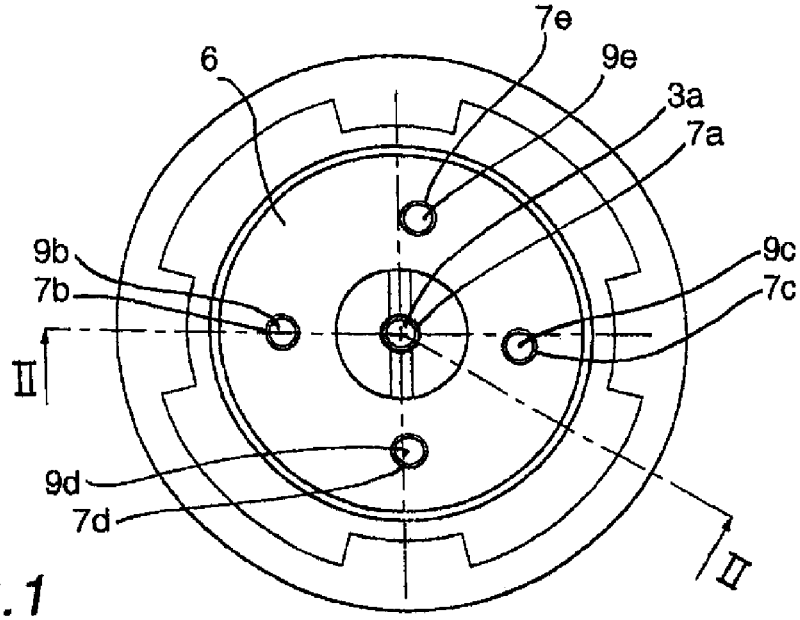
Figure 2:
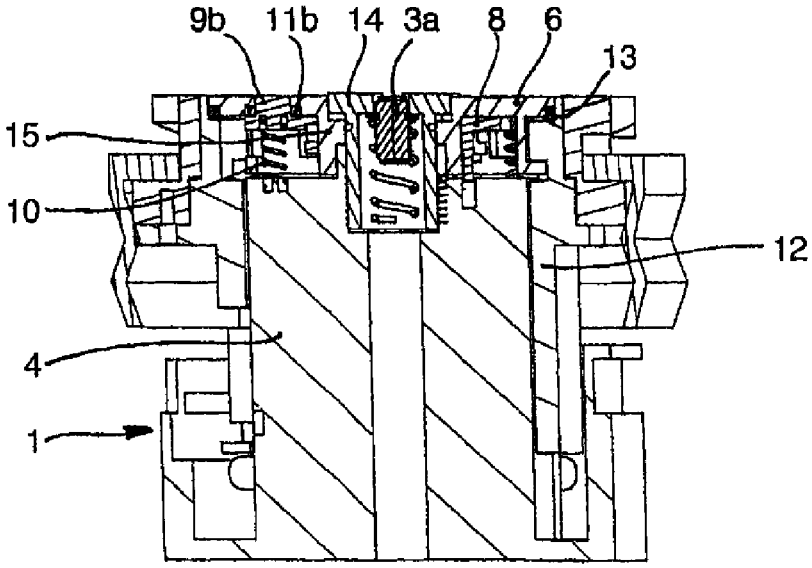
Figure 3:
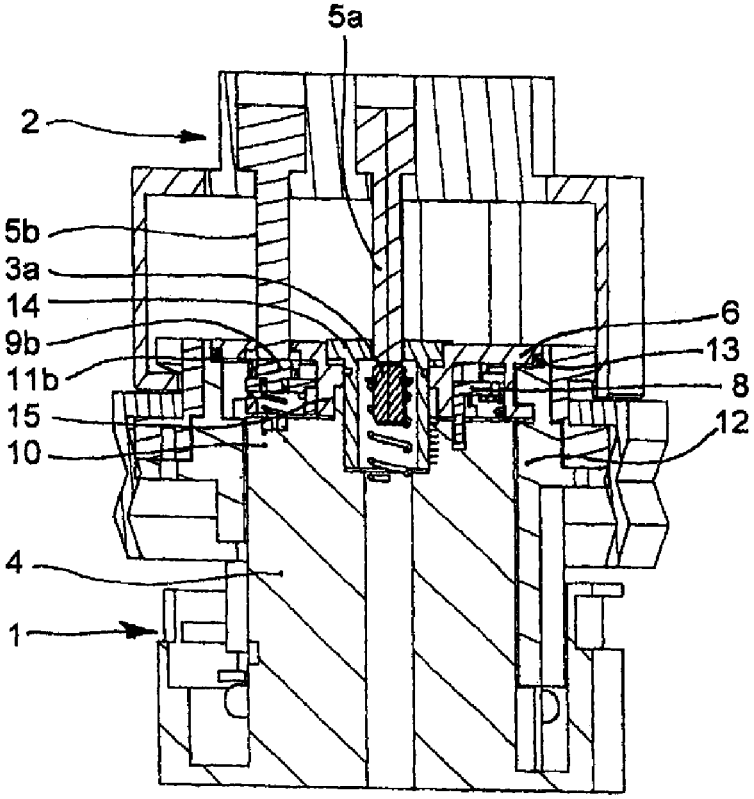
Figure 4:
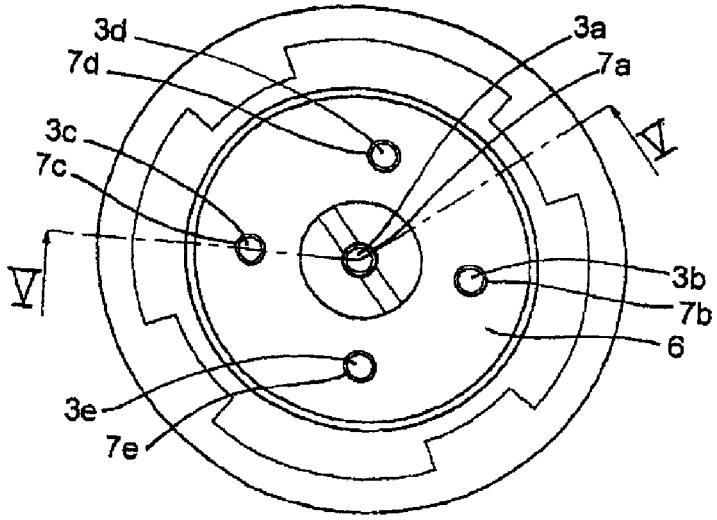
Figure 5:
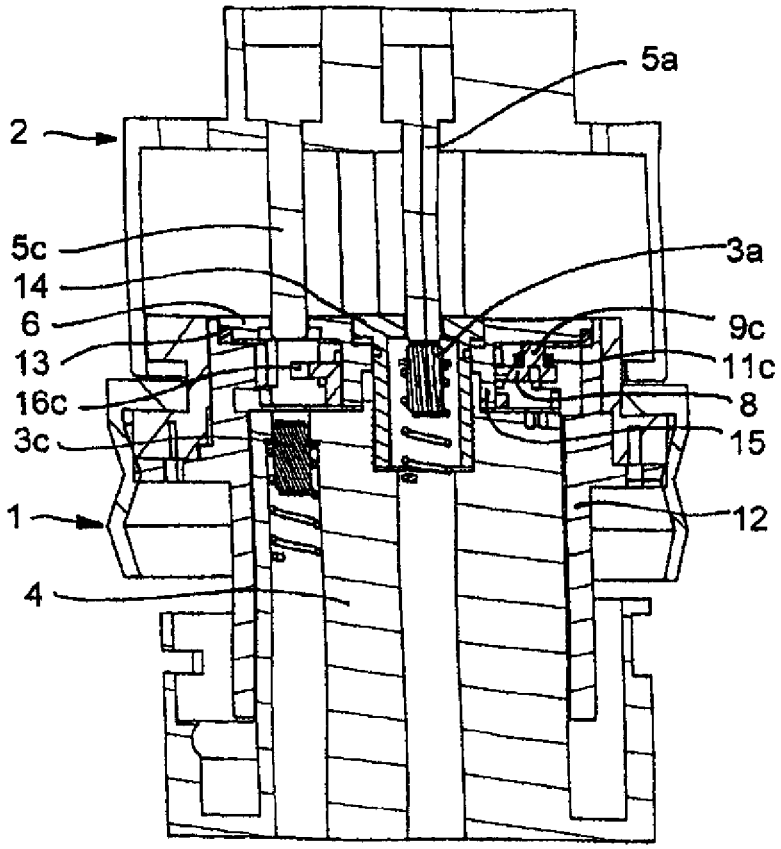

The element 1 is intended to be coupled with a plug 2 shown schematically in FIGS. 3 and 5.

The connection element 1 contains several contacts and, in the represented example, apart from a ground contact 3*a* arranged in the center, it is equipped with four peripheral contacts 3*b*-3*e* (FIGS. 4 and 5) in a certain spatial relationship, distributed in the represented example, e.g., in the same circumference and only one of which 3*c* is visible in FIG. 5, said peripheral contacts constituting for example a neutral contact and three phase contacts.

In this example, the represented contacts are so-called end contacts arranged in the compartments of an insulating block 4 and biased by springs also arranged in the insulating block 4.

The connection element 1 is intended as already mentioned to be coupled to a plug such as the plug 2 shown schematically in FIGS. 3 and 5, which is equipped with as many contact pins (such as the central pin 5*a* and the peripheral pins 5*b* and 5*c*) as the number of contacts possessed by the element 1 itself.

Figure 4:
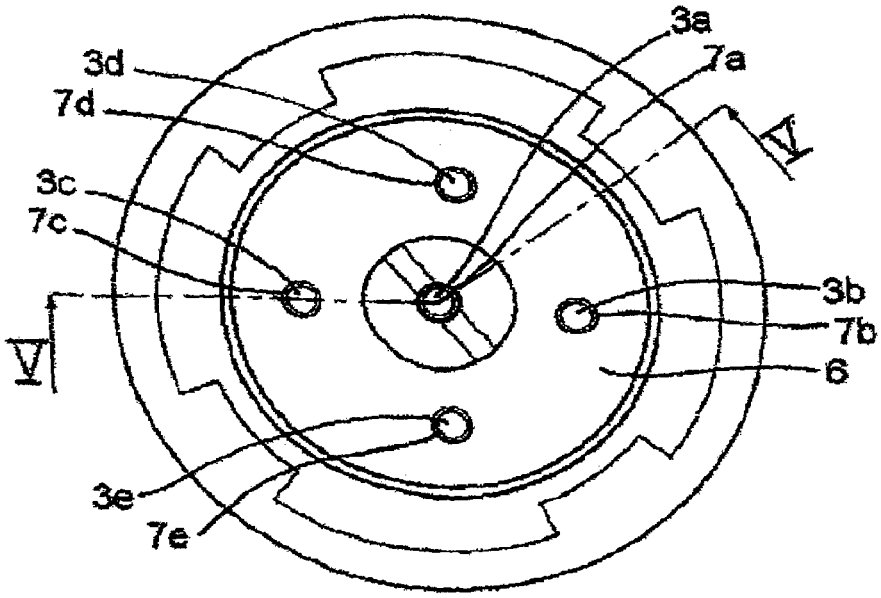
FIG. 4 is a view corresponding to FIG. 1 after a rotation movement of the safety disk, positioning the latter in the connection position.

The connection element 1 also includes, in a conventional manner, above the insulating block 4, a rotary safety disk 6 equipped with perforations 7*a*-7*e*, the number and positioning of which are selected, on the one hand, in such a way as to conceal the peripheral contacts 3*b*-3*e* of the connection element 1 at rest (position of FIGS. 1 to 3) and, on the other hand, to be superimposed on the latter after rotation of the safety disk (position shown in FIGS. 4 and 5).

The plug 2 and the connection element 1 are in fact provided with a combined arrangement for ensuring their coupling, such coupling including inserting, in a first translation movement, the pins 5*a*-5*c* of the plug into the corresponding perforations 7*a*-7*c* of the safety disk 6, then carrying along the latter in rotation until the peripheral pins of the plug are aligned with the peripheral contacts of the connection element (FIG. 5) and to terminate the coupling and thus the connection with a final translation movement (not shown) until the connection element 1 and the plug 2 are locked by appropriate means.

To ensure a sealed protection of the peripheral contacts of the connection element which is generally under voltage, the invention provides for the positioning of a sealing disk 8 underneath the safety disk.

The sealing disk 8 includes as many sealing blocks 9*b*-9*e* and perforations such as 16*c* (FIG. 5) as the safety disk includes peripheral perforations 7*b*-7*e* and which are positioned in the same way with an angular offset specified between the blocks and the perforations of the sealing disk.

Figure 1:
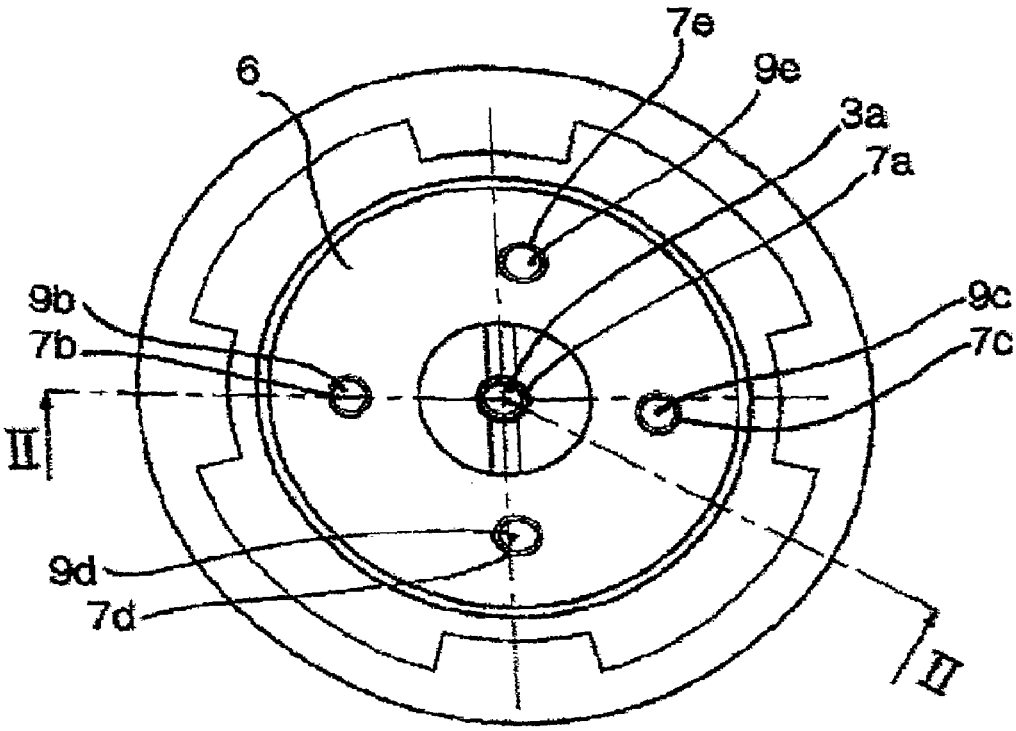
FIG. 1 shows, by way of example, a connection element according to the invention, viewed from the end and in the resting position.
Figure 2:
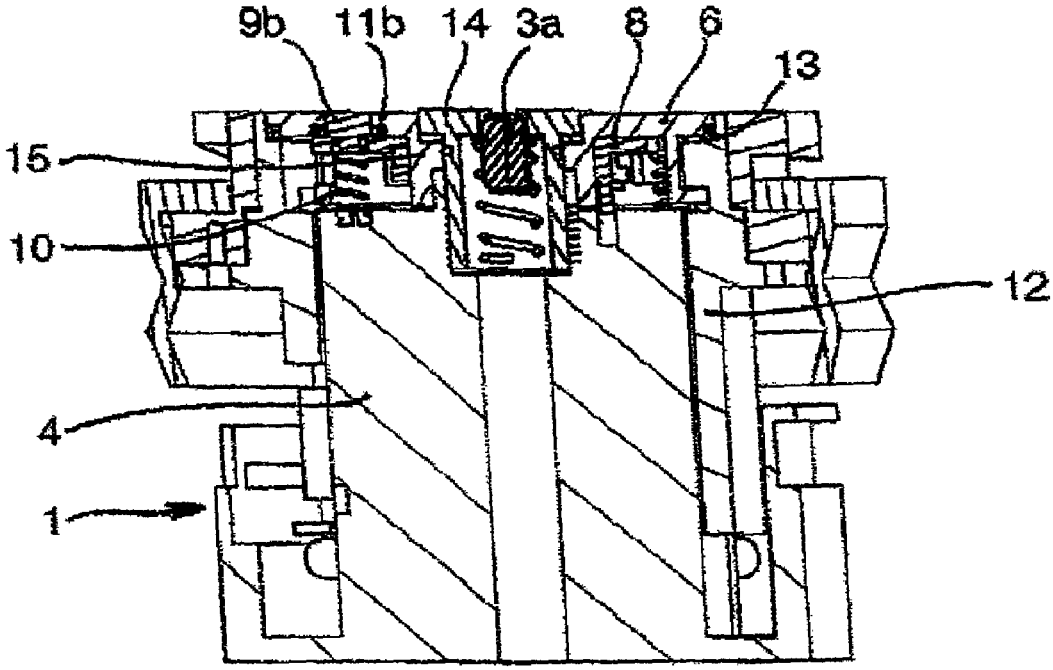
FIG. 2 is a cross-section according to II-II of FIG. 1.

In addition, the sealing disk 8 is mounted fixed in rotation, but movable in translation, while it is urged towards the safety disk 6 by an elastic arrangement and, in the case in question here, by springs such as 10 (FIGS. 2 and 3) in such a way that, at rest, the blocks 9*b*-9*e* of the sealing disk 8 come to close the corresponding perforations of the safety disk 6, as illustrated in FIGS. 1 and 2.

To ensure a sealed closure, the blocks 9*b*-9*e*, which are presented in the form of lugs with a shape corresponding to the perforations to be closed, are provided at their base with annular joints such as 11*b* and 11*c* (FIGS. 2, 3 and 5) which remain arranged on the safety disk 6 and under which they come to be applied in the closure position.

The safety disk 6 is mounted rotatively in a sheath 12 surrounding the insulating block 4 and it also cooperates with a peripheral joint 13 housed in an appropriate groove in the sheath 12.

In addition, as shown in FIGS. 2, 3 and 5, the safety disk 6 and the sealing disk 8 are assembled by a sleeve 14 around which the safety disk 6 turns. The sealing disk 8 is mounted in a movable manner in translation on a central tubular extension 15 of the safety disk 6, by means of a central perforation which it possesses and the shape of which is combined with the shape of the extension of the safety disk.

In this way, it is to be understood that, at rest, the sealing disk 8, as already stated, ensures the seal with respect to the peripheral contacts 3*b*-3*e* of the connection element (FIGS. 1 and 2).

During the coupling, the first translation movement of the plug 2 permits the pushing back of the sealing blocks 9*b*-9*e* against the force of the springs 10. This can be regarded as a transition from a first configuration of the electrical connection element 1 to a second configuration.

The safety disk 6 can then be driven in rotation to assume the position of FIGS. 4 and 5, a position in which the peripheral pins of the plug, such as the pin 5*c* in FIG. 5, are located, as already mentioned, in alignment with the corresponding peripheral contacts of the connection element 1, such as the contact 3*c* in FIG. 5. This can be regarded as a transition from the second configuration of the electrical connection element 1 to a third configuration. To establish the connection during the final translation movement as specified above, the peripheral pins pass across the sealing disk 8 through the perforations with which it is equipped, such as the perforation 16*c* visible in FIG. 5.

The reverse uncoupling manipulations, of course, ensure the return of the blocks 9*b*-9*e* into a sealed position under the effect of the springs 10.

Words such as "above" and "under" are used herein for convenience in describing relationships depicted in the various drawing figures, and such description is not to be understood to limit the invention to the particular orientation shown in the drawing, whereby the plug-coupling end of the connection element 1, with contacts 3*a*-3*e*, is shown to be uppermost. For example, the description of the safety disk 6 being "over" the insulating block 4 is intended to be synonymous with a description of the safety disk 6 being closer to the plug-coupling end of the connection element I than is the insulating block 4. Likewise, the description of the sealing disk 8 being "under" the safety disk 6 is intended to be synonymous with a description of the sealing disk 8 being farther from the plug-coupling end of the connection element 1 than is the safety disk 6.

The invention claimed is:

1. An electrical connection element comprising:

an insulator block;

a plurality of peripherally distributed electrical contacts mounted in the insulator block, said electrical contacts structured and arranged to cooperate with corresponding contact pins of a plug after the electrical connection element is coupled to the plug, such coupling including, from a resting position of the safety disk, at least the following successive movements: (a) a first translation, (b) a rotation, and (c) a second translation;

a rotary safety disk positioned above the insulating block, said rotary safety disk comprising a predeterminate number of peripheral perforations arranged in a predeterminate manner within said safety disk so as:

(a) in the resting position of the safety disk, to allow the safety disk to conceal the peripheral contacts of the connection element; and (b) after a rotation of the safety disk, performed by the contact pins of the plug after having been inserted into the perforations of the disk during said first translation, to be superimposed over the peripheral contacts;

a sealing disk positioned under the safety disk, said sealing disk being fixed against rotation and movable in translation against a bias of an elastic arrangement;

said sealing disk comprising sealing blocks positioned on said sealing disk in said predeterminate number of said peripheral perforations of the safety disk, said elastic arrangement biasing the sealing blocks toward the safety disk;

said sealing disk further comprising peripheral perforations in at least said predeterminate number of said safety disk and arranged in said predeterminate manner of the peripheral perforations of the safety disk, while being offset angularly in relation to said sealing blocks;

said sealing blocks of said sealing disk being structured and arranged so as:

(a) in said resting position of the safety disk, to seal closed said peripheral perforations of the safety disk under the bias of said elastic arrangement;

(b) during said first translation, to be disengaged from said peripheral perforations of the safety disk by the pins of the plug, thereby allowing said rotation of said safety disk performed by the contact pins of the plug being within the perforations of the disk; and said peripheral perforations of said sealing disk being structured and arranged so as:

after said rotation, to allow the pins of the plug to extend into said peripheral perforations of said sealing disk and to come into an electrical connection position with said electrical contacts that are mounted in the insulator block;

said sealing disk adapted to reassume a sealed closure position during an uncoupling of the plug and the electrical connection element, under the bias of said elastic arrangement.

2. An electrical connection element according to claim 1, wherein:

the safety disk is equipped with a central extension;

the sealing disk has a central perforation extending around the central extension of the safety disk for mounting the sealing disk for translation on said central extension of the safety disk.

3. An electrical connection element according to claim 1, wherein:

the elastic arrangement which biases the sealing disk towards the safety disk comprises springs positioned under respective ones of the sealing blocks of the sealing disk.

4. An electrical connection element according to claim 1, wherein:

each of said sealing blocks is composed of a lug with a shape corresponding to a perforation of the safety disk to be sealed and an annular joint arranged at a base of such perforation, said annular joint being applied in the closure position under the safety disk.

5. An electrical connection element according to claim 1, further comprising:

an arrangement to ensure a seal of a periphery of the safety disk between the safety disk and the insulating block.

6. An electrical connection element according to claim 5, wherein:

the arrangement for ensuring the seal at the periphery of the safety disk comprises:

a peripheral groove arranged in a sheath surrounding the insulating block in which the safety disk is rotatable; and an annular joint housed in said groove of the sheath.

7. An electrical connection element adapted to be coupled to a plug having contact pins, said electrical connection element comprising:

an insulator block;

a plurality of electrical end contacts mounted in the insulator block in a certain spatial relationship, said electrical end contacts structured and arranged to cooperate with the contact pins of the plug after the electrical connection element is coupled to the plug;

a rotary safety disk movable from a resting position to a rotated position, said rotary safety disk having perforations at least equal in number to, and in said spatial relationship of, said plurality of electrical end contacts;

in said resting position of said rotary safety disk, said rotary safety disk covering the electrical end contacts;

in said rotated position of said rotary safety disk, said perforations of rotary safety disk superimposed over the electrical end contacts;

a sealing disk positioned under the safety disk, said sealing disk being fixed against rotation and movable in translation against a bias of an elastic arrangement;

said sealing disk comprising upwardly projecting sealing blocks in said certain spatial relationship of the perforations of the safety disk, said elastic arrangement biasing the sealing blocks toward the safety disk;

said sealing disk further comprising perforations at least equal in number to, and in said spatial relationship of the perforations of the safety disk, while being offset angularly in relation to said sealing blocks;

said coupling of the electrical connection element to the plug requiring a transition of the electrical connection element from a first configuration to a second configuration and from the second configuration to a third configuration;

in said first configuration of the electrical connection element, said rotary safety switch is in said resting position covering the electrical end contacts and said sealing blocks of the sealing disk extend through respective ones of the perforations of the safety disk;

said transition from said first configuration to said second configuration comprises a translation of the plug relative to the electrical connection element while the safety disk is in said resting position;

in said second configuration of the electrical connection element, the contact pins of the plug are positioned within the perforations of the safety disk while engaging and retracting respective ones of the sealing blocks of the sealing disk from the perforations of the safety disk;

said transition from said second configuration to said third configuration comprises a rotation of the plug while the contact pins of the plug are positioned within the perforations of the safety disk to thereby drive the safety disk from said resting position to said rotated position;

in said third configuration of the electrical connection element, the pins of the plug are positioned within the perforations of the sealing disk and are in a position of electrical contact with said electrical contacts mounted in the insulator block.

8. An electrical connection element according to claim 7, wherein:

the safety disk is equipped with a central extension;

the sealing disk has a central perforation, the central extension of the safety disk extends through said central perforation for mounting the sealing disk for translation on said central extension of the safety disk.

9. An electrical connection element according to claim 7, wherein:

the elastic arrangement which biases the sealing blocks toward the safety disk comprises springs positioned under respective ones of the sealing blocks.

10. An electrical connection element according to claim 7, wherein:

each of said sealing blocks is composed of a lug with a shape corresponding to a perforation of the safety disk to be sealed and an annular joint arranged at a base of such perforation, said annular joint being applied in the closure position under the safety disk.

11. An electrical connection element according to claim 7 in combination with the plug.

12. An electrical connection element according to claim 7, further comprising:

an arrangement to ensure a seal of a periphery of the safety disk between the safety disk and the insulating block.

13. An electrical connection element according to claim 12, wherein:

the arrangement for ensuring the seal at the periphery of the safety disk comprises:

a peripheral groove arranged in a sheath surrounding the insulating block in which the safety disk is rotatable; and an annular joint housed in said groove of the sheath.

* * * * *

UNITED STATES PATENT AND TRADEMARK OFFICE

CERTIFICATE OF CORRECTION

PATENT NO. : 7,491,080 B2
APPLICATION NO. : 11/995078
DATED : February 17, 2009
INVENTOR(S) : Mounim Houir Alami et al.

It is certified that error appears in the above-identified patent and that said Letters Patent is hereby corrected as shown below:

Title Page

On the Title page, the Assignee name "Societe d'Exploitation des Porcedes Marechal (SEPM)" should be --Société d'Exploitation des Procédés Maréchal (SEPM)--.

Delete the title page containing an illustrative figure and substitute the attached title page therefor.

In Drawings

Delete figures 1-5 and substitute the attached figures 1-5 therefor.

Signed and Sealed this

Seventh Day of July, 2009

John Doll

JOHN DOLL
*Acting Director of the United States Patent and Trademark Office*

(12) United States Patent
Houir Alami et al.

(10) Patent No.: US 7,491,080 B2
(45) Date of Patent: Feb. 17, 2009

(54) SEALED ELECTRICAL CONNECTION ELEMENT

(75) Inventors: Mounim Houir Alami, Paris (FR); Arnaud Calbel, Vaires sur Marne (FR)

(73) Assignee: Societe d'Exploitation des Porcedes Marechal (SEPM), Saint Maurice (FR)

( * ) Notice: Subject to any disclaimer, the term of this patent is extended or adjusted under 35 U.S.C. 154(b) by 0 days.

(21) Appl. No.: 11/995,078

(22) PCT Filed: Mar. 16, 2007

(86) PCT No.: PCT/FR2007/000455

§ 371 (c)(1),
(2), (4) Date: Jan. 8, 2008

(87) PCT Pub. No.: WO2007/118948

PCT Pub. Date: Oct. 25, 2007

(65) Prior Publication Data

US 2008/0200055 A1 Aug. 21, 2008

(30) Foreign Application Priority Data

Mar. 17, 2006 (FR) ..... 06 02358

(51) Int. Cl.
*H01R 13/52* (2006.01)

(52) U.S. Cl. ..... 439/277; 439/294

(58) Field of Classification Search ..... 439/271–277, 439/289, 292–294, 587–589

See application file for complete search history.

(56) References Cited

U.S. PATENT DOCUMENTS 4,203,640 A * 5/1980 Bice et al. ..... 439/139

FOREIGN PATENT DOCUMENTS

| | | |
|---|---|---|
| DE | 90 13 436 U1 | 1/1991 |
| DE | 199 63 614 A1 | 8/2000 |
| FR | 2 551 272 A1 | 3/1985 |
| WO | WO-00/31836 A1 | 6/2000 |

* cited by examiner

*Primary Examiner*—Tho D Ta
(74) *Attorney, Agent, or Firm*—Greenblum & Bernstein, P.L.C.

(57) ABSTRACT

Electrical connection element provided with peripherally distributed electrical contacts designed to cooperate with the corresponding contact pins of a plug, a rotary safety disk being provided and having peripheral perforations the number and position of which are chosen, on the one hand, at rest, to conceal the peripheral contacts of the connection element and, on the other hand, be superimposed therewith when the disk driven by the pins of the plug is rotated, whereas sealing blocks are positioned under the safety disk so as to seal off the peripheral perforations thereof in the rest position. The sealing blocks are positioned on a sealing disk also provided with perforations, and which is formed under the safety disk and mounted fixed in terms of rotation and able to move in terms of translation against the action of an elastic arrangement which biases it towards the safety disk.

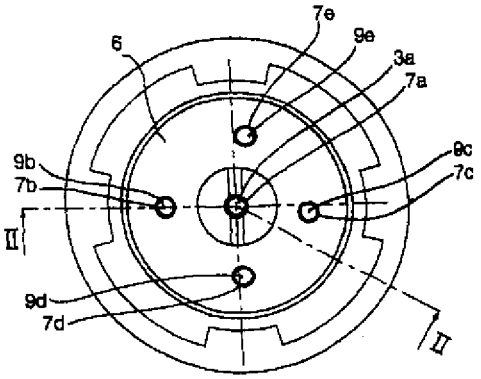

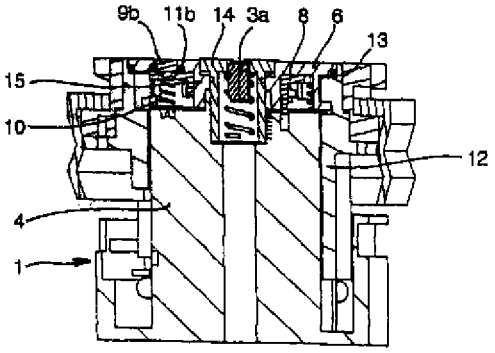

13 Claims, 3 Drawing Sheets